United States Patent [19]

Schimmel

[11] 4,198,893

[45] Apr. 22, 1980

[54] DAMPER FOR PIANOS

[75] Inventor: Nikolaus Schimmel, Wolfenbuttel, Fed. Rep. of Germany

[73] Assignee: Wilhelm Schimmel Pianofortefabrik GmbH, Brunswick, Fed. Rep. of Germany

[21] Appl. No.: 928,576

[22] Filed: Jul. 27, 1978

[30] Foreign Application Priority Data

Aug. 2, 1977 [DE] Fed. Rep. of Germany ..... 2734700

[51] Int. Cl.[2] ..... G10C 3/16

[52] U.S. Cl. ..... 84/255

[58] Field of Search ..... 84/255

[56] References Cited

U.S. PATENT DOCUMENTS 391,495 10/1888 Umland ..... 84/255

FOREIGN PATENT DOCUMENTS 2315324 10/1973 Fed. Rep. of Germany ..... 84/255

*Primary Examiner*—Lawrence R. Franklin

[57] ABSTRACT

A damper for pianos comprises a damper block arranged on a pivotable lever or rod and is limited substantially on all sides by convex outer surfaces, and a damper head cooperating with the piano wire and engageable with the damper block through complementary curved surfaces.

7 Claims, 6 Drawing Figures

Fig.1
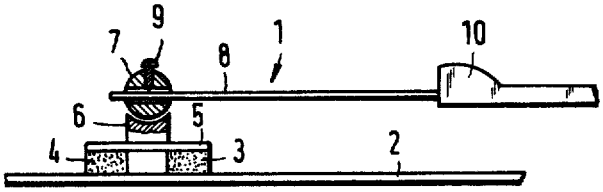
Fig.4
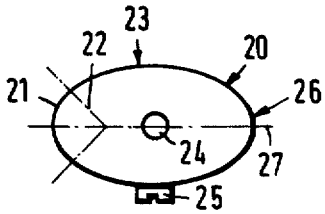
Fig.2
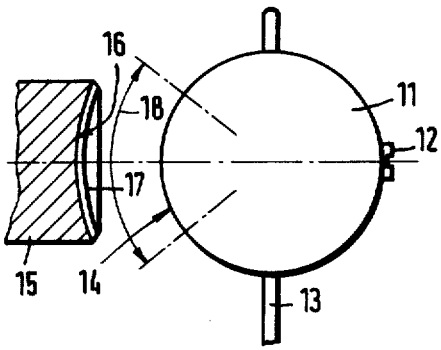
Fig.5
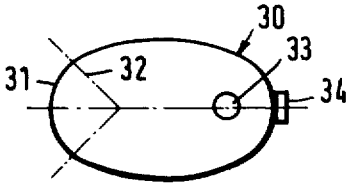
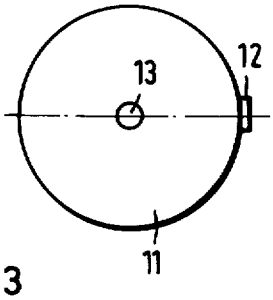
Fig.3
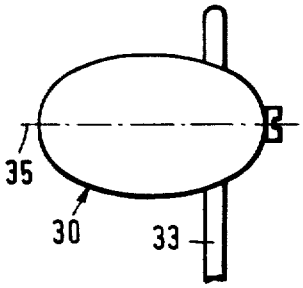
Fig.6

DAMPER FOR PIANOS

BACKGROUND OF THE INVENTION

The invention relates to a damper in which a damper block is arranged on a pivotable rod or lever and a damper head cooperates with a piano wire and is connected to the damper block by complementary curved surfaces.

Dampers of this type are known (cf. German Patent Specification No: 3221 or German Gebrauchsmuster No: 73 11 598).

In this type of damper, the work of aligning the damper head or the damper elements fixed thereto in relation to the piano wire is substantially simplified in manufacture of pianos i.e. independently of whether the damper head is connected to the damper block permanently via a layer of adhesive or detachably by means of a connecting device. The damper heads can be aligned automatically in relation to the piano wire with simultaneous and relative displacement with respect to the related damper block owing to the complementary curved connecting surfaces between the damper head and the damper block, before the damper block and the damper head are fixed together.

In the manufacture of pianos, more particularly of those having certain requirements with regard to quality, it is not only important to align the damper heads automatically in relation to the wire so that they abut optimally with their felt blocks and rest fully on the related piano wires. It is also necessary to align the damper blocks arranged on the pivotable lever or on a rod in rows in relation to each other and parallel to common reference planes. If such an alignment process has to take into account both the workmanship and aesthetic requirements for a quality piano, then this alignment process is necessary in many cases and, with the known dampers, requires a large amount of skill and a considerable expenditure in terms of time and labour and involves high costs. Thus the fact that the damper blocks are limited by flat surfaces which are essentially at right angles to each other, apart from the curved connection surface for the damper head, plays an important part. The difficulty of alignment lies in the fact that the damper block can be out of alignment in its spatial arrangement in relation to the common reference plane of the row of damper blocks in various respects. With reference to the damper lever or to the damper rod, the damper block must be aligned longitudinally of the rod and cross-wise thereto. The damper block can be twisted or tilted however about its longitudinal axis or about the two axes running cross-wise thereto. With the large number of these damper blocks arranged in a row, alignment of the damper blocks is a difficult task. Thus it is quite clear that alignment of the damper blocks must take place inside the common row before the damper heads carrying the felt blocks or the like are aligned in relation to the piano strings and are connected to the damper blocks, since each subsequent correction in the position of the damper block would lead to a worsening of the optimum abutment of the felt blocks against the piano strings.

SUMMARY OF THE INVENTION

It is an object of the invention to substantially simplify the alignment in rows of the damper blocks and to facilitate this alignment and thus to lower the costs involved.

According to the invention, there is provided a damper for pianos comprising a pivotable lever or rod, a damper block arranged on said lever or rod limited substantially on all sides by convex outer surfaces and a damper head cooperating with the piano wire and having a base part defining a surface complementary to an outer surface of said damper block and in engagement with said outer surface.

BRIEF DESCRIPTION OF THE DRAWINGS

The invention will now be described in greater detail, by way of example with reference to the drawings, in which:

FIG. 1 shows a damper in the preferred form and the related piano wire in side view, partially in section, and in fact before final fixed connection between the damper block and the related damper head;

FIG. 2 shows the damper block on a larger scale and shows the related damper head in side view;

FIG. 3 shows the arrangement according to FIG. 2 in plan view;

FIG. 4 shows an end view of another form of damper;

FIG. 5 shows an end view of a further embodiment of the damper, and

FIG. 6 is a side view of the embodiment of FIG. 5.

DESCRIPTION OF THE PREFERRED EMBODIMENT

In its wider forms, the invention proposes a damper for pianos of the kind mentioned at the outset, wherein the damper block is limited substantially on all sides by convex outer surfaces.

By avoiding flat limiting surfaces for the damper block, it is ensured that small deviations in the actual position of a damper block from the optimally aligned position within the row are substantially more difficult to notice with the human eye than in the case of a damper block with surfaces which are essentially flat and at right angles to each other. As a result of the rotationally symmetrical construction of the damper block about at least one of its axes, a twisted position of the damper block about this axis of symmetry cannot lead to any errors of alignment. Alignment about the axis of symmetry is therefore not necessary.

At the same time it is clear from this that, with rotationally symmetrical construction of the damper block about more than one of its axes, the problem of alignment is gradually reduced. In preferred manner, therefore, the construction of the damper block is as a sphere having a uniform radius.

Practical comparisons have shown that the expense and the time required to align the damper blocks can be reduced by means of the new measures in relation to the previously known dampers to half or less. Thus there is no special skill necessary on the part of the person who is entrusted with this alignment.

After aligning the damper blocks in rows in the case of the damper in accordance with the invention, automatic alignment of the damper heads carrying the felt elements or the like takes place in relation to the piano wires and connection of the aligned damper heads with the damper blocks already aligned previously.

A preferred embodiment of the new damper is shown in FIGS. 1 and 2.

The damper is designated 1 in FIG. 1. The damper 1 is assigned to a certain piano wire 2. As is known, a piano covers a number of piano wires 2 which are arranged so as to be adjacent and in parallel in the same plane and so as to run perpendicular to the drawing plane, whereby a damper 1 is assigned to each piano wire. This means that, in accordance with the number of wires 2, a number of dampers 1 is provided and they are the same type and are arranged in a row perpendicular to the drawing plane.

Each damper has a damper head which comprises a base portion 5 and, in the example shown, two damper elements 3 and 4 fixed thereto comprising a resilient material, for example felt and comprising a connecting portion 6 carrying the base part 5. The connecting portion 6 has a concave connecting surface which serves for abutment against a correspondingly or complementary convex connecting surface of a damper block 7. The damper block 7 and the damper head 6 can be connected together permanently or detachably. In the following, it is assumed that a permanent connection is provided by using a layer of glue etc in the region of the complementary curved connecting surfaces.

The damper block 7 is fixed to a lever-shaped damper rod 8 so as to be detachable and displaceable. The rod projects through a corresponding borehole in the damper block. The fixing takes place with the aid of a fixing screw 9. The damper rod 8 is arranged on a damper arm 10 which is mounted pivotally in the usual manner in the piano.

In the preferred embodiment the damper block 11 comprises a sphere having a constant curved radius. The sphere has a borehole and an adjusting screw 12 with the aid of which the sphere according to FIGS. 2 and 3 can be displaced along the rod 13. The damper head 15 is fixed to the portion of the spherical surface designated 14, the expanse of which is indicated at 18, and the damper head 15 has a complementary concave partial spherical surface 16 at its side facing it, the partial spherical surface 16 being covered by a layer of adhesive or glue 17. In order to align the damper head 15 or its damper elements in relation to the piano wire, the damper head is brought against the piano wire 2 in full abutment, before hardening of the layer 17 of glue, by means of the damper block 11, until the glue has ensured a solid permanent connection between the damper head 15 and the damper block 11.

Before aligning the damper head 15 in relation to the piano string all the damper blocks 11 of the damper which belong to the same row of dampers must be aligned with respect to each other and in relation to a common reference plane. This alignment of the damper blocks in the piano in rows can be achieved exceptionally simply rapidly and without any special skill owing to the spherical shape of the damper block 11. If the carrier rods 8 are all located in the same plane then the damper blocks 7 or 11 respectively need only be displaced further in the longitudinal direction of the rods 8 up to the common position of alignment of their centres of gravity. Thus care will be taken still to see that the fixing screws 9 or 12 respectively point to the same side in all of the damper blocks in order to improve the impression which is correct in terms of aesthetics and in terms of craft.

While the spherical shape of the damper block 11 is preferred damper block shapes are possible which deviate from the spherical shape in which substantially the whole of the outer surface of the damper block is convex and the damper block is constructed so as to be rotationally symmetrical about at least one of its axes. Two examples of this are shown in FIGS. 4 to 6.

In the embodiment in accordance with FIG. 4 the damper block 20 is rotationally symmetrical about its longitudinal axis 27. In each cross-section containing the longitudinal axis 27 there is an elliptical outline, ie. with end regions 21 and 26 having a fairly small curve radius and a peripheral region 23 containing the fixing screw 25 and the borehole for the fixing rod 24 of fairly large radius. The end region 21 with the angle expansion 22 serves as a connecting surface for fixing the damper head.

In the embodiment according to FIGS. 5 and 6 the borehole for the rod 33 is offset towards an end region in which end region the fixing screw 34 is provided. This region has a smaller curve radius than the other end region 31 which is limited by the angle expansion 32 and serves to fix the damper head to the damper block 30. The axis about which the damper block 30 is constructed in rotationally symmetrical manner is designated 35.

It will be understood that the above description of the present invention is susceptible to various modification changes and adaptations.

What is claimed is:

1. A piano damper comprising a pivotal supporting rod, a damper block secured to said rod for selective axial displacement therealong, the entire outer surface of said damper block being convexedly curved and rotationally symmetrical about at least one of its axis, a damper head having a planar base, a damper pad on one surface of said base adapted to engage the piano wire and a concave seat on its other surface having a curvature complementing the surface of said damper head for adhesively receiving said damper head.

2. A damper as defined in claim 1 wherein said damper block comprises a sphere having a uniform radius.

3. A damper as defined in claim 1 wherein the outer surface of said damper block in the region of connection to said pivotable rod defines a curve of a radius which is larger than the radius of the surface engaged within the seat of said damper head.

4. A damper as defined in claim 3, wherein the surface of said damper block in engagement with said complementary surface of the seat of said damper head is part spherical.

5. A damper as defined in claim 3, wherein said damper block is rotationally symmetrical about its longitudinal axis.

6. A damper as defined i claim 5, wherein said damper block is egg-shaped.

7. A damper as defined in claim 5, wherein said damper block is an ellipsoid.

* * * * *